US011000855B1

(12) United States Patent
Moon

(10) Patent No.: US 11,000,855 B1
(45) Date of Patent: May 11, 2021

(54) GARBAGE DISPOSAL WASTE LINE UNCLOGGING SYSTEM

(71) Applicant: Richard A. Moon, Surprise, AZ (US)

(72) Inventor: Richard A. Moon, Surprise, AZ (US)

( * ) Notice: Subject to any disclaimer, the term of this patent is extended or adjusted under 35 U.S.C. 154(b) by 0 days.

(21) Appl. No.: 16/902,405

(22) Filed: Jun. 16, 2020

(51) Int. Cl.

| | |
|---|---|
| ***B02C 18/00*** | (2006.01) |
| ***A47L 15/42*** | (2006.01) |
| ***B02C 23/18*** | (2006.01) |
| ***B02C 18/12*** | (2006.01) |
| ***E03C 1/306*** | (2006.01) |
| ***E03C 1/266*** | (2006.01) |

(52) U.S. Cl.
CPC ..... *B02C 18/0084* (2013.01); *A47L 15/4223* (2013.01); *B02C 18/12* (2013.01); *B02C 23/18* (2013.01); *E03C 1/2665* (2013.01); *E03C 1/306* (2013.01); *B02C 2201/06* (2013.01)

(58) Field of Classification Search
CPC ..... B02C 18/0084; B02C 23/18; B02C 18/12; B02C 2201/06; E03C 1/306; E03C 1/2665; A47L 15/4223
See application file for complete search history.

(56) References Cited

U.S. PATENT DOCUMENTS

| | | | | |
|---|---|---|---|---|
| 1,885,977 | A | 11/1932 | Denison | |
| 2,536,372 | A | 1/1951 | Jordan | |
| 2,750,121 | A | 6/1956 | Schmidt | |
| 3,034,734 | A | 5/1962 | Guth | |
| 3,526,547 | A * | 9/1970 | Shock | E03C 1/284 134/22.12 |
| 5,249,749 | A | 10/1993 | Krebsbach | |
| 6,193,879 | B1 * | 2/2001 | Bowman | B01D 61/08 210/153 |
| 8,579,217 | B2 | 11/2013 | Chesak | |
| 8,819,872 | B2 | 9/2014 | Bradley et al. | |
| 2003/0131886 | A1 | 7/2003 | Walker | |
| 2007/0084950 | A1 | 4/2007 | Hohl | |
| 2007/0170289 | A1 | 7/2007 | Okada et al. | |
| 2016/0122986 | A1 | 5/2016 | Gormley et al. | |
| 2017/0356175 | A1 | 12/2017 | Doung | |
| 2019/0210036 | A1 * | 7/2019 | Chavez | B02C 18/0092 |

OTHER PUBLICATIONS

NIBCO Wye fitting 4 in. x 4 in. x 2 in. PVC DWV H x H x H Wye by NIBCO from Home depot https://www.homedepot.com/p/NIBCO-4-in-x-4-in-x-2-in-PVC-DWV-H-x-H-x-H-Wye-C4810HD442/100345172 (Year: 2014).*

* cited by examiner

*Primary Examiner* — Michael E Barr
*Assistant Examiner* — Pallavi Chitta
(74) *Attorney, Agent, or Firm* — Goldstein Law Offices, P.C.

(57) ABSTRACT

An unclogging system for the plumbing of a sink/garbage disposal assembly including a water supply line, a sink drain waste line, a garbage disposal waste line, and an end-outlet tee having a first inlet, a second inlet connected to the sink drain waste line, and an interior baffle disposed adjacent to the first inlet. The system includes a coupling adaptor having a waste-in end attached to the garbage disposal waste line, a waste-out end attached to the first inlet, a hollow interior for the passage of fluid/waste therethrough, and an inlet port. A water jet tube extending through the inlet port into the interior directs water toward the waste-out end and at the baffle. A solenoid valve allowing a flow of water from the water supply line to the water jet tube is coupled to a power outlet, which simultaneously powers the solenoid valve and the garbage disposal.

20 Claims, 5 Drawing Sheets

GARBAGE DISPOSAL WASTE LINE UNCLOGGING SYSTEM

TECHNICAL FIELD

The present disclosure relates generally to plumbing systems and devices. More particularly, the present disclosure relates to an unclogging system for preventing and removing backups and/or clogs present in garbage disposal waste lines.

BACKGROUND

Garbage disposals are used to process food waste, garbage and/or other waste into particulates small enough to pass through drain plumbing associated with sinks. Indeed, a conventional garbage disposal is configured to be mounted onto a sink drain extending downward from a corresponding sink such that water and waste discharged from the sink may be directed into the disposal. The water/waste is typically directed into a grind chamber positioned above a grinding mechanism of the disposal. The waste contained within the grind chamber is typically ground, shredded, cut and/or otherwise processed into small particulates by the grinding mechanism. The processed waste may then be discharged from the disposal through a garbage disposal waste line that is coupled to the main sink drain waste line as well as an exit waste line at a junction.

In conventional plumbing of a kitchen sink assembly having a garbage disposal, an end-outlet tee, also known as a waste tee, or baffle tee, interconnects the sink drain waste line, the garbage disposal waste line, and the exist waste line. The end-outlet tee includes a first inlet connected to the sink drain waste line, a second inlet connected to the garbage disposal waste line, an outlet connected to the exit waste line, and an interior baffle that keeps waste/water from the sink drain waste line/garbage disposal waste line from entering the garbage disposal waste line/sink drain waste line at the junction of the waste lines. To function as it does, the baffle protrudes inwardly into the interior of the end-outlet tee so as to guide and direct the flow of water/waste flowing through the junction. However, this creates a deficiency in that the baffle decreases the diameter of the end-outlet tee at the areas adjacent to the first inlet and second inlet and acts as an object that impedes the flow of waste. Indeed, the baffle creates areas at the first inlet and the second inlet that have a smaller orifice through which waste/water may flow, thereby creating a bottleneck effect at the areas of the junction that are adjacent to the baffle. As such, over time, processed waste from the garbage disposal accumulates at the baffle and the areas adjacent thereto causing backups and/or clogs.

Accordingly, there is a need for an unclogging system configured to provide a stream of water to the area adjacent to the baffle of an end-outlet tee of a sink plumbing system in order to prevent and remove any backups and/or clogs of processed food within the waste line.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a garbage disposal waste line unclogging system for preventing and unclogging backups and clogs in the plumbing of kitchen sink assemblies having a sink, a garbage disposal, a switched power outlet adjacent to the garbage disposal, the garbage disposal including a power line coupled to and deriving power from the switched power outlet, the plumbing including a water supply line, a sink drain waste line, a garbage disposal waste line, an exit waste line, and an end-outlet tee, including a first inlet, a second inlet, an outlet, and interior baffle disposed adjacent to the first inlet, the end-outlet tee interconnecting the sink drain waste line, the garbage disposal waste line, and the exit waste line. Accordingly, the present disclosure provides a drain line coupling adaptor including a waste-in end attached to the garbage disposal waste line and a waste-out end attached to the first inlet of the end-outlet tee. The drain line coupling adaptor includes a tubular member having a hollow interior for allowing the passage of waste and fluids through the drain line coupling adaptor between the waste-in end and the waste-out end and an inlet port providing access to the interior of the drain line coupling adaptor. A water jet tube extends into the interior of the drain line coupling adaptor and is oriented toward the waste-out end to direct a jet of water to the waste-out end and the baffle of the end-outlet tee that is adjacent to the waste-out end.

Another aspect of an example embodiment in the present disclosure is to enable the garbage disposal waste line unclogging system to operate with plumbing having a horizontal garbage disposal waste line coupled to a vertical sink drain waste line as well as plumbing having a vertical garbage disposal waste line coupled to a horizonal sink drain waste line. Accordingly, in the former plumbing system, the drain line coupling adaptor makes a horizontal connection between the garbage disposal waste line and the first inlet of the end-outlet tee. In this system, the tubular member is linear and the inlet port is angled with respect to the tubular member toward the waste-out end. In the latter plumbing system, the drain line coupling adaptor makes a vertical connection between the garbage disposal waste line and the first inlet of the end-outlet tee. In this system, the tubular member is an elbow-shaped tubular member including a first arm attached to the garbage disposal waste line and a second arm attachable to the first inlet end-outlet tee, the second arm having the waste-out end. In this system, the inlet port is parallel with respect to the second arm and perpendicular with respect to the first arm to guide the water jet tube toward the waste-out end.

Yet another aspect of an example embodiment in the present disclosure is to provide a means for directing and delivering a jet of water to the baffle of the end-outlet tee. Accordingly, the present disclosure provides a water supply tube in fluid communication with a water supply line and a solenoid valve connecting the water supply tube to the water jet tube. Actuation of the solenoid valve allows the flow of water from the water supply tube to the water jet tube. The water jet tube includes a smaller diameter to deliver high pressure water to the drain line coupling adaptor.

Still another aspect of an example embodiment of the present disclosure is to provide a means for electrically connecting the solenoid valve to the switched power outlet such that the solenoid valve and garbage disposal may operate in parallel and be powered on simultaneously by the same switch. Accordingly, the present disclosure provides an electrical connecter coupling to the solenoid valve and the garbage disposal power line to the switched power outlet. The electrical connector derives power from the switched power outlet such that when the switched power outlet is powered, the switched disposal outlet simultaneously powers the solenoid valve and the garbage disposal.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
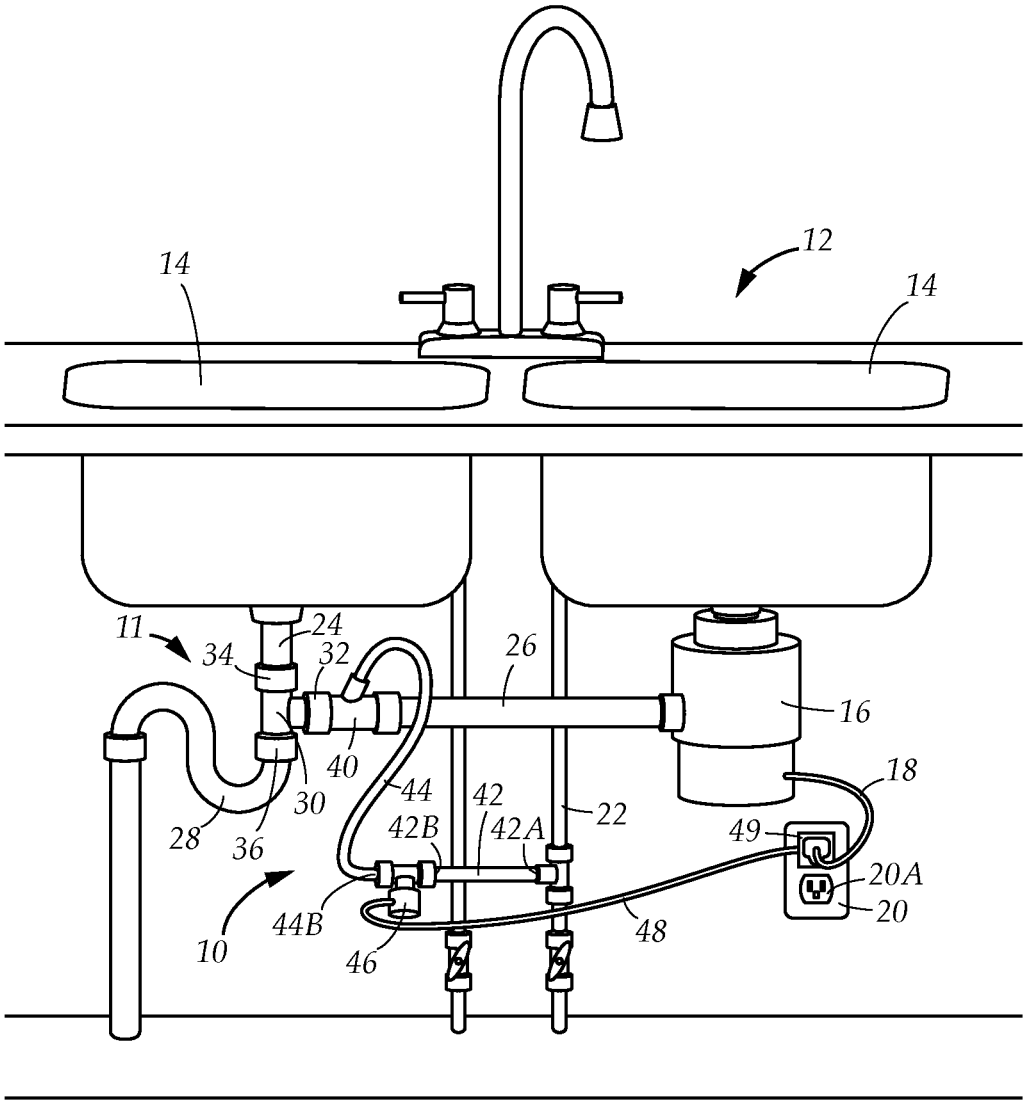
FIG. 1 is a perspective view of the garbage disposal waste line unclogging system, illustrating the system in use with a sink assembly plumbing system having a horizontal garbage disposal waste line coupled to the vertical sink drain waste line via an end-outlet tee according to one embodiment of the present disclosure.
Figure 2:
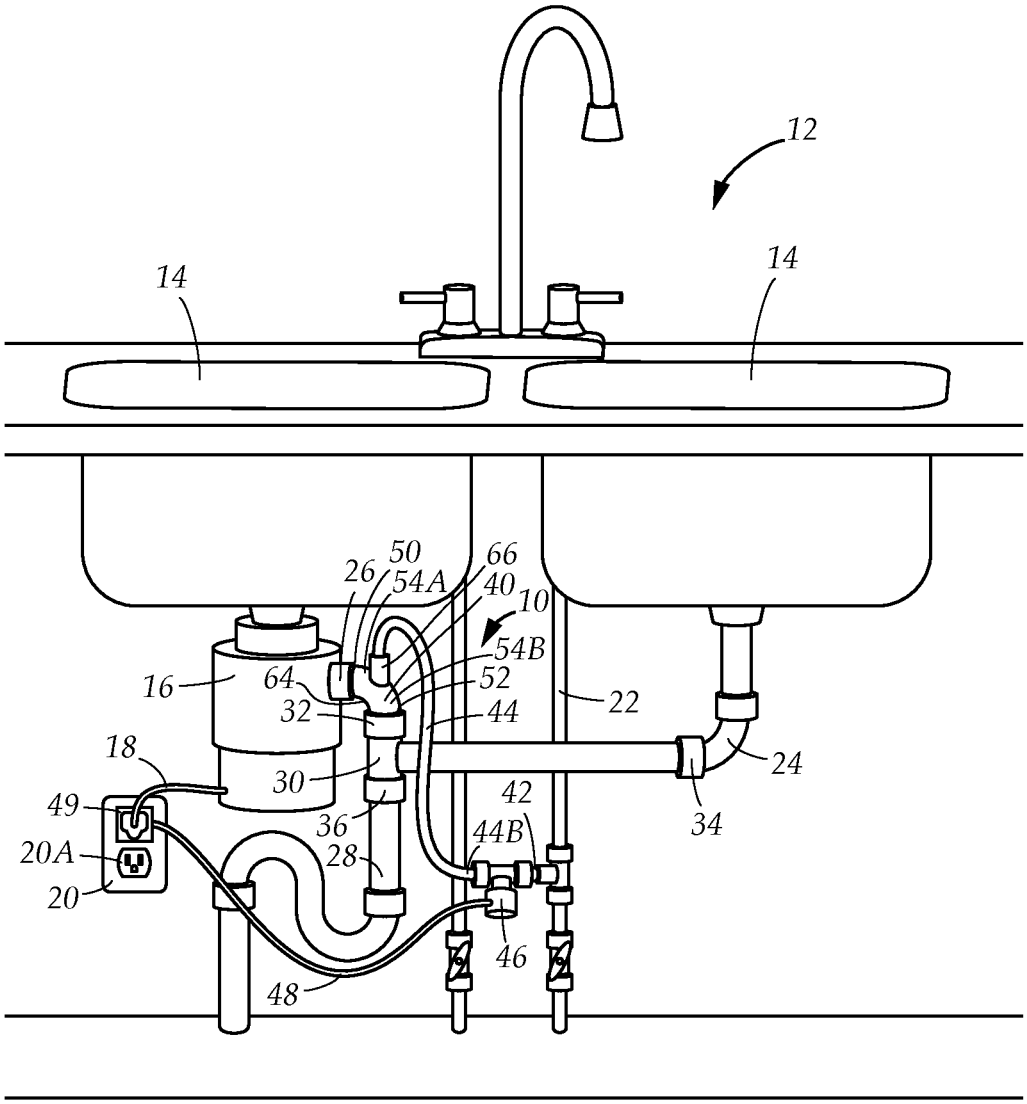
FIG. 2 is a perspective view of the garbage disposal waste line unclogging system, illustrating the system in use with a sink assembly plumbing system having a vertical garbage disposal waste line coupled to a horizontal sink drain waste line via an end-outlet tee according to one embodiment of the present disclosure.

FIGS. 1 and 2 illustrate a garbage disposal waste line unclogging system 10 for preventing and removing clogs in the plumbing 11 of a sink assembly 12 having a sink 14, a garbage disposal 16 including a garbage disposal power line 18, and a switched power outlet 20 adjacent to the garbage disposal 16 that includes a pair of female receptacles 20A and is coupled to and provides power to the garbage disposal power line 18. The plumbing 11 includes a water supply line 22, a sink drain waste line 24 coupled to the sink 14, a garbage disposal waste line 26 coupled to the garbage disposal 16, an exit waste line 28, and an end-outlet tee 30 including a first inlet 32, a second inlet 34, an outlet 36 connected to the exit waste line 28, and an interior baffle 38 (see FIG. 3) disposed adjacent to the first inlet 32. The end-outlet tee 30 interconnects the sink drain waste line 24, the garbage disposal waste line 26, and the exit waste line 28.

The system 10 includes a drain line coupling adaptor 40 connecting the garbage disposal waste line 26 and the end-outlet tee 30, a water supply tube 42 in fluid communication with the water supply line 22, a water jet tube 44 coupled to the drain line coupling adaptor 40, and a solenoid valve 46 connecting the water supply tube 42 to the water jet tube 44. The water supply tube 42 includes a water inlet end 42A connected to the water supply line 22 and a water outlet end 42B connected to the solenoid valve 46. The water jet tube 44 includes a water exit end 44A (See FIG. 3) extending into the drain line coupling adaptor 40 and a water entrance end 44B coupled to the solenoid valve 46. The water jet tube 44 is flexible and includes a smaller diameter than the water supply tube 42 and the water supply line 22 to expel high pressure water toward the baffle 38.

The solenoid valve 46 is coupled to and derives power from the switched power outlet 20 such that when powered, it allows a flow of water from the water supply tube 42 to the water jet tube 44. The solenoid valve 46 is coupled to the switched power outlet 20 via an electrical cable 48 that includes an electrical connector 49 that plugs into, or otherwise connects to, the switched power outlet 20. In this way, when the switched power outlet 20 is powered on, the switched power outlet 20 simultaneously powers the solenoid valve 46 and the garbage disposal 16 to allow a user to operate the water jet tube 44 at the same time as the garbage disposal 16. Note, one of the female receptacles 20A of the switched power outlet 20 is occupied by the garbage disposal power line 18, while the other female receptacle is unoccupied.

Although not shown, the electrical connector 49 includes a male plug that connects to the switched power outlet 20 and a female receptacle that receives and connects to the garbage disposal power line 18. The electrical connector 49, shown in its most basic form, is connecting the switch power outlet 20, the garbage disposal power line 18, and the solenoid valve 46 in parallel, but in other embodiments, the electrical connector 49 may comprise a circuit breaker to selectively disrupt power to the garbage disposal 16 and the solenoid valve 46 and/or may be configured to enable smart control.

Figure 3:
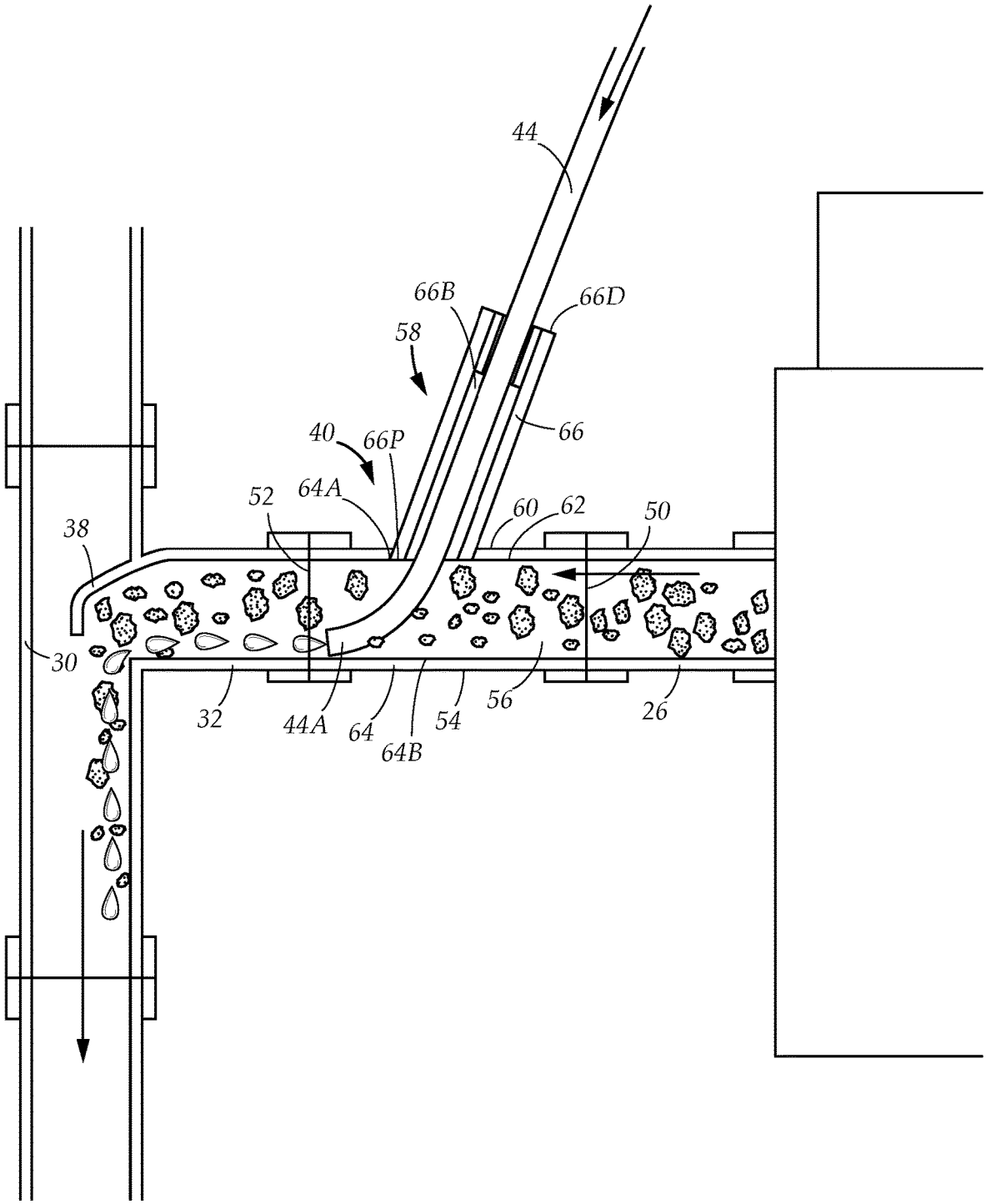
FIG. 3 is a cross-sectional view of the garbage disposal waste line unclogging system in use, illustrating the water jet tube extending through the inlet port into the interior of the tubular member and directing a jet of water toward the waste-end of the drain line coupling adaptor and the baffle of the end-outlet tee according to one embodiment of the present disclosure.

Referring now to FIG. 3, the drain line coupling adaptor 40 comprises a waste-in end 50 attached to the garbage disposal waste line 26 and a waste-out end 52 attached to the first inlet 32 of the end-outlet tee 30. The drain line coupling adaptor 40 includes a tubular member 54 having a hollow interior 56 for allowing the passage of waste and fluids through the drain line coupling adaptor 40 between the waste-in end 50 and the waste-out end 52, and an inlet port 58 providing access to and guiding the water jet tube 44 into the interior 56 of the tubular member 54. The tubular member 54 is linear in structure and includes an outer surface 60 and an interior surface 62 defining a cylindrical wall 64 circumscribing the interior 56. The cylindrical wall 64 includes a first side 64A and a second side 64B opposite the first side 64A.

The inlet port 58 comprises a protruding member 66 that extends outwardly from the first side 64A of the cylindrical wall 64 at an obtuse angle with respect to the waste-out end 52 and an acute angle with respect to the waste-in end 50 such that the inlet port 58 is angled toward the waste-out end. The protruding member 66 includes a free distal end 66D, a proximal end 66P attached to the cylindrical wall 64, and a bore 66B in communication with the interior 56 of the drain line coupling adaptor 40. The bore 66B extends entirely between the free distal end 66D and the proximal end 66P.

The water exit end 44A of the water jet tube 44 extends through the bore 66B of the inlet port 58 into the interior 56 such that it is oriented toward the waste-out end 52. In embodiments, the water exit end 44A extends diametrically across the interior 56 of the tubular member 54 such that it is positioned against the second side 64B of the cylindrical wall 64 and is substantially parallel to the cylindrical wall 64 to direct water substantially orthogonally at the waste-out end 52 and directly at the baffle 38. In this way, the water jet tube 44 may direct water at the baffle 38 to prevent and/or remove any backups or clogs present at the baffle 38 or at areas adjacent to the baffle 38.

Referring back to FIG. 2, in embodiments, the drain line coupling adaptor 40 is curvilinear, or elbow-shaped, and includes a first arm 54A including the waste-in end 50 and a second arm 54B opposite the first arm 54A that includes the waste-out end 52. In this embodiment, the protruding member 66 extends from the cylindrical wall 64 of the drain line coupling adaptor 40 parallel to the first arm 54A and the waste-out end 52 such that it is angled toward the waste-out end 52.

Figure 4:
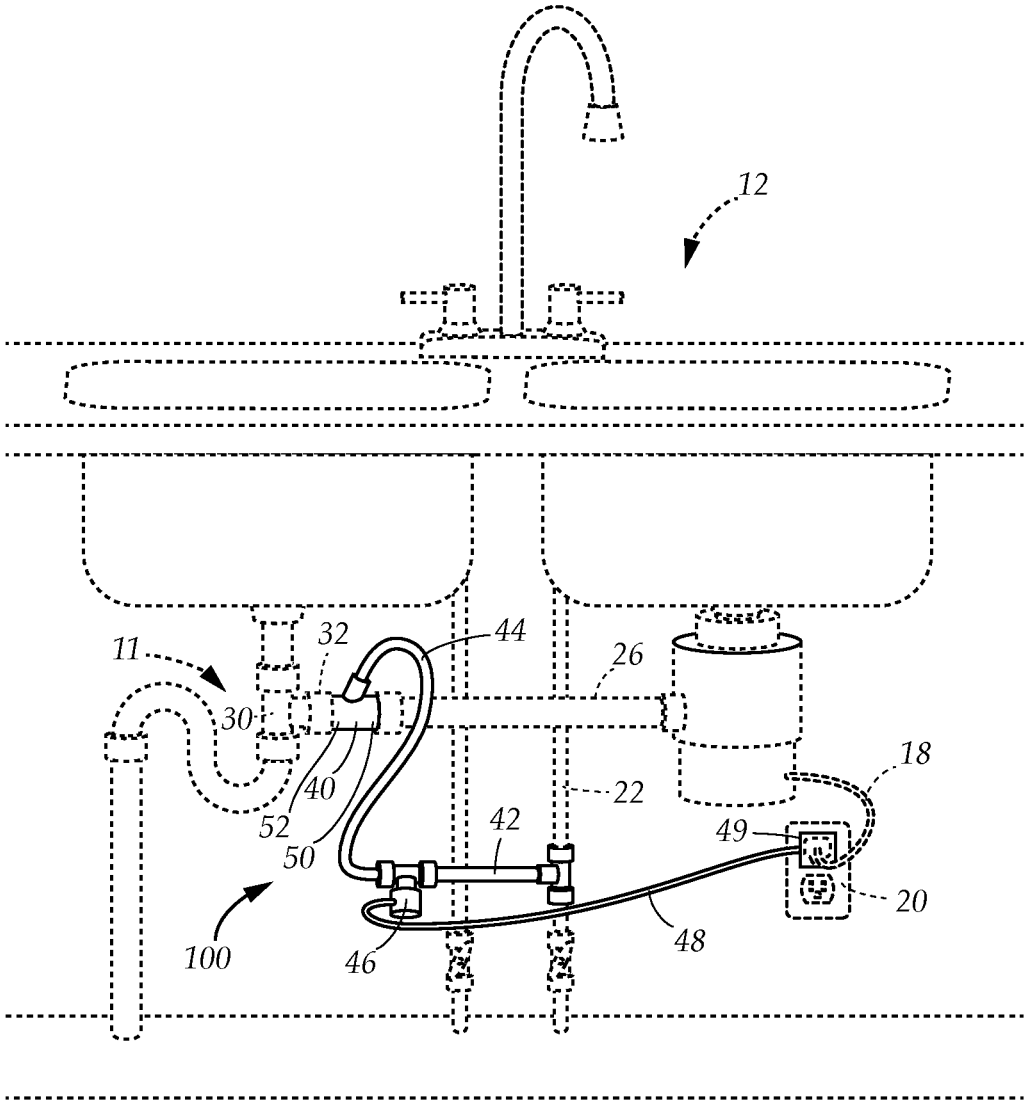
FIG. 4 is a perspective view of the garbage disposal waste line unclogging system, illustrating the components of the system in broken lines according to one embodiment of the present disclosure.
Figure 5:
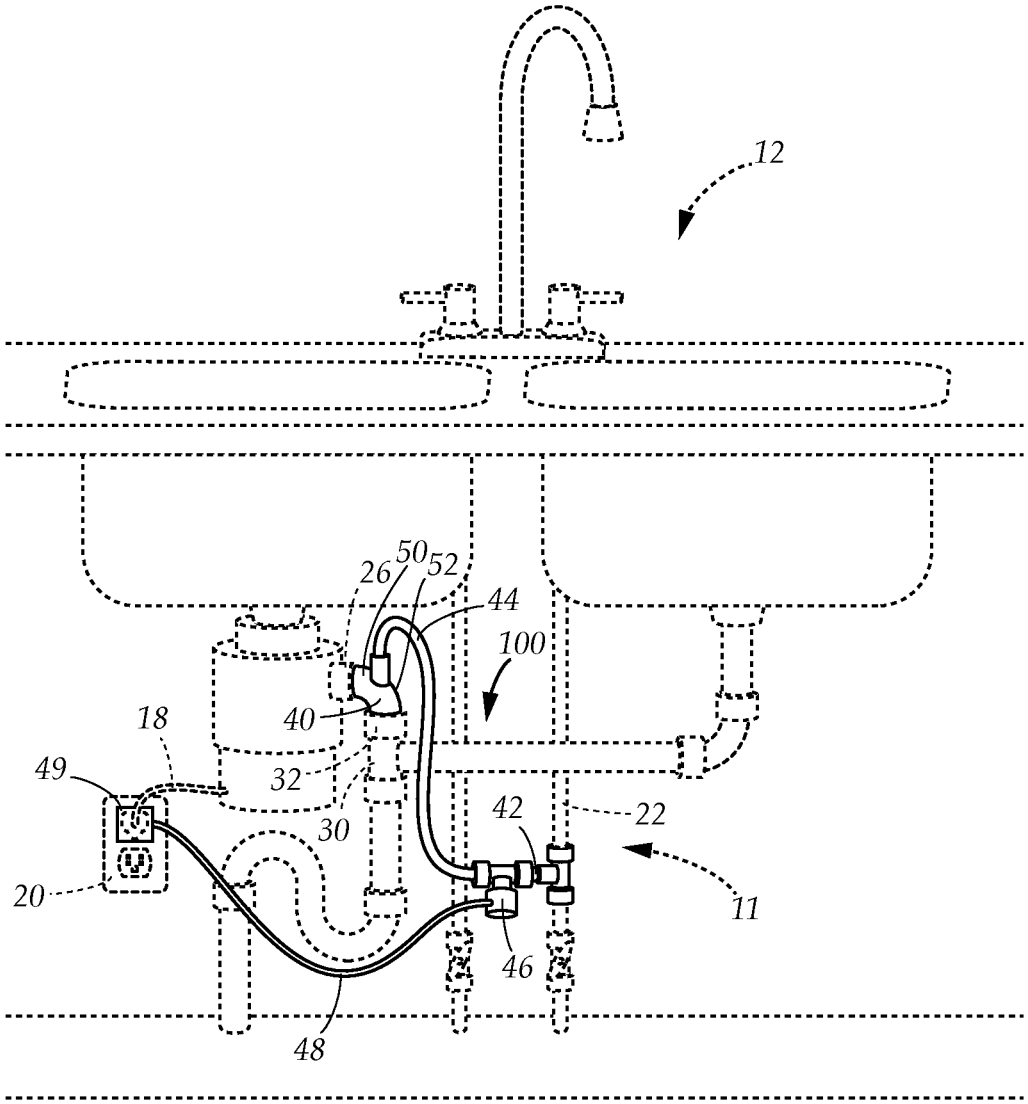
FIG. 5 is a perspective view of the garbage disposal waste line unclogging system, illustrating the components of the system in broken lines according to another embodiment of the present disclosure.

FIGS. 4 and 5 illustrate the individual components of the system in operation. In embodiments, the components of the system may be provided as a kit 100 for retrofitting over the plumbing 11 of the sink assembly 12. Note, the plumbing 11 and the sink assembly are shown in broken lines. The kit 100 may include the drain line coupling adaptor 40 as described above, the water supply tube 42 as described above, the water jet tube 44 as described above, the solenoid valve 46 as described above, and the electrical cable 48 as described above, but all as individual components or otherwise partially connected to each other. In this way, a user may modify the plumbing 11 of the sink assembly 12 with the kit 100 in order to prevent and remove clogs formed in the plumbing 11.

In one operation, a user may retrofit the plumbing 11 with the kit 100 by inserting the drain line coupling adaptor 40 between the garbage disposal waste line 26 and end-outlet tee 30 and connecting the waste-in end 50 of the drain line coupling adaptor 40 to the garbage disposal waste line 26 and the waste-out end 52 to the first inlet 32 of the end-outlet tee 30. Next, a user may connect the water supply tube 42 to the water supply line 22 to establish a water supply to the water supply tube 42. Next, a user may connect the water jet tube 44 to the solenoid valve 46 and the solenoid valve 46 to the water supply tube 42 to control the flow of water from the water supply tube 42 to the water jet tube 44. Lastly, a user may connect the electrical cable 48 to the switched power outlet 20 via the electrical connector 49 to connect the switch power outlet 20, the garbage disposal power line 18, and the solenoid valve 46 in parallel. Note, the order in which the components of the kit 100 are retrofit onto the plumbing 11 may vary depending on user preference or the particular plumbing system to be retrofit.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly. The term "substantially" is defined as at least 95% of the term being described and/or within a tolerance level known in the art and/or within 5% thereof.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a garbage disposal waste line unclogging system. The disclosure is illustrated by example in the drawing figures, and throughout the written description. It should be understood that numerous variations are possible, while adhering to the inventive concept. Such variations are contemplated as being a part of the present disclosure.

What is claimed is:

1. A garbage disposal waste line unclogging system for preventing and removing clogs in the plumbing of a sink assembly having a sink, a garbage disposal, and a switched power outlet adjacent to the garbage disposal, the garbage disposal including a power line coupled to and deriving power from the switched power outlet, the plumbing including a water supply line, a sink drain waste line coupled to the sink, a garbage disposal waste line coupled to the garbage disposal, an exit waste line, and an end-outlet tee including a first inlet, a second inlet, an outlet connected to the exit waste line, and an interior baffle disposed adjacent to the first inlet, the end-outlet tee interconnecting the sink drain waste line, the garbage disposal waste line, and the exit waste line, the system comprising:

a drain line coupling adaptor having a waste-in end attached to the garbage disposal waste line and a waste-out end attached to the first inlet of the end-outlet tee, the drain line coupling adaptor including a tubular member having a hollow interior for allowing the passage of waste and fluids through the drain line coupling adaptor between the waste-in end and the waste-out end, and an inlet port providing access to the interior of the drain line coupling adaptor;

a water supply tube in fluid communication with the water supply line;

a water jet tube having a water exit end and a water entrance end, the water jet tube extending through the inlet port into the interior of the drain line coupling adaptor, the water exit end oriented toward the waste-out end and the interior baffle of the end-outlet tee therebeyond;

a solenoid valve connecting the water supply tube and the water jet tube, the solenoid valve coupled to and deriving power from the switched power outlet such that when the switched power outlet is powered on, the switched power outlet simultaneously powers the solenoid valve and the garbage disposal, the solenoid valve allowing a flow of water from the water supply line to the water jet tube when powered.

2. The system of claim 1, wherein the inlet port extends from the tubular member at an obtuse angle with respect to the waste-out end and an acute angle with respect to the waste-in end such that the inlet port is angled toward the waste-out end.

3. The system of claim 2, wherein the tubular member is linear and includes an outer surface and an interior surface defining a cylindrical wall circumscribing the interior of the drain line coupling adaptor, the cylindrical wall having a first side and a second side opposite the first side.

4. The system of claim 3, wherein the inlet port includes a protruding member extending outwardly from the first side of the cylindrical wall, the protruding member including a free distal end, a proximal end attached to the cylindrical wall, and a bore in communication with the interior of the drain line coupling adaptor, the bore extending between the free distal end and the proximal end.

5. The system of claim 4, wherein the inlet port guides the water jet tube through the bore into the interior, the water jet tube extending diametrically across the interior such that the water exit end is positioned against the second side of the cylindrical wall and is substantially parallel with respect to the cylindrical wall to direct water substantially orthogonally at the waste-out end and directly at the baffle.

6. The system of claim 5, wherein the solenoid valve is coupled to the switched power outlet via an electrical cable that is plugged into and derives power from the switched power outlet, the electrical cable including an electrical connector for connecting the electrical cable to the switched power outlet to establish an electrical connection therebetween.

7. The system of claim 1, wherein the inlet port extends from the tubular member that is parallel with respect to the waste-out end such that the inlet port is angled toward the waste-out end.

8. The system of claim 7, wherein the tubular member is curvilinear and includes a first arm including the waste-in end, a second arm including the waste-out end, the first arm opposite to the second arm, and an outer surface defining a cylindrical wall.

9. The system of claim 8, wherein the inlet port includes a protruding member extending from the outer surface, the protruding member including a free distal end and a proximal end attached to the cylindrical wall.

10. The system of claim 9, wherein the solenoid valve is coupled to the switched power outlet via an electrical cable that is plugged into and derives power from the switched power outlet, the electrical cable including an electrical connector for connecting the electrical cable to the switched power outlet to establish an electrical connection therebetween.

11. A garbage disposal waste line unclogging kit for preventing and removing clogs in the plumbing of a sink assembly having a sink, a garbage disposal, and a switched power outlet adjacent to the garbage disposal, the garbage disposal including a power line coupled to and deriving power from the switched power outlet, the plumbing including a water supply line, a sink drain waste line coupled to the sink, a garbage disposal waste line coupled to the garbage disposal, an exit waste line, and an end-outlet tee including a first inlet, a second inlet, an outlet connected to the exit waste line, and an interior baffle disposed adjacent to the first inlet, the end-outlet tee interconnecting the sink drain waste line, the garbage disposal waste line, and the exit waste line, the kit comprising:

a drain line coupling adaptor having a waste-in end configured to attach the garbage disposal waste line and a waste-out end configured to attach to the first inlet of the end-outlet tee, the drain line coupling adaptor including a tubular member having a hollow interior for allowing the passage of waste and fluids through the drain line coupling adaptor between the waste-in end and the waste-out end, and an inlet port providing access to the interior of the drain line coupling adaptor;

a water supply tube configured to connect to the water supply line to establish a fluid connection therewith;

a water jet tube having a water exit end and a water entrance end, the water jet tube extending through the inlet port into the interior of the drain line coupling adaptor, the water exit end oriented toward the waste-out end and the interior baffle of the end-outlet tee therebeyond;

a solenoid valve configured to connect the water supply tube and the water jet tube, the solenoid valve including an electrical cable having an electrical connector configured to plug into and derive power from the switched power outlet such that when the switched power outlet is powered on, the switched power outlet simultaneously powers the solenoid valve and the garbage disposal, the solenoid valve allowing a flow of water from the water supply tube to the water jet tube when powered.

12. The kit of claim 11, wherein the inlet port extends from the tubular member at an obtuse angle with respect to the waste-out end and an acute angle with respect to the waste-in end such that the inlet port is angled toward the waste-out end.

13. The kit of claim 12, wherein the tubular member is linear and includes an outer surface and an interior surface defining a cylindrical wall circumscribing the interior of the drain line coupling adaptor, the cylindrical wall having a first side and a second side opposite the first side.

14. The kit of claim 13, wherein the inlet port includes a protruding member extending outwardly from the first side of the cylindrical wall, the protruding member including a free distal end, a proximal end attached to the cylindrical wall, and a bore in communication with the interior of the drain line coupling adaptor, the bore extending between the free distal end and the proximal end.

15. The kit of claim 14, wherein the inlet port is configured to guide the water jet tube through the bore into the interior of the drain line coupling adaptor, the water jet tube extending diametrically across the interior such that the water exit end is positioned against the second side of the cylindrical wall and is substantially parallel with respect to the cylindrical wall to direct water substantially orthogonally at the waste-out end and directly at the baffle.

16. The kit of claim 15, wherein:

the water supply tube includes a water inlet end that connects to the water supply line and a water outlet end that connects to the solenoid valve; and the water entrance end of the water jet tube connects to the solenoid valve.

17. The kit of claim 11, wherein the tubular member is curvilinear and includes a first arm including the waste-in end, a second arm including the waste-out end, the first arm opposite the second arm, and an outer surface, defining a cylindrical wall.

18. The kit of claim 17, wherein the inlet port extends from the tubular member that is parallel with respect to the second arm such that the inlet port is angled toward the waste-out end.

19. The kit of claim 18, wherein the inlet port includes a protruding member extending from the outer surface, the protruding member including a free distal end and a proximal end attached to the cylindrical wall.

20. The kit of claim 19, wherein:

the water supply tube includes a water inlet end that connects to the water supply line and a water outlet end that connects to the solenoid valve; and the water entrance end of the water jet tube connects to the solenoid valve.

* * * * *